US008821596B2

(12) United States Patent
Stevenson et al.

(10) Patent No.: US 8,821,596 B2
(45) Date of Patent: Sep. 2, 2014

(54) NITROGEN-FREE DEPOSIT CONTROL FUEL ADDITIVES AND ONE STEP PROCESS FOR THE MAKING THEREOF

(75) Inventors: Paul R. Stevenson, Belper (GB); David J. Moreton, Belper (GB); William R. S. Barton, Belper (GB); David C. Arters, Solon, OH (US); Jeffry G. Dietz, Shaker Hts., OH (US)

(73) Assignee: The Lubrizol Corporation, Wickliffe, OH (US)

( * ) Notice: Subject to any disclaimer, the term of this patent is extended or adjusted under 35 U.S.C. 154(b) by 20 days.

(21) Appl. No.: 13/515,837

(22) PCT Filed: Dec. 17, 2010

(86) PCT No.: PCT/US2010/060908

§ 371 (c)(1),
(2), (4) Date: Sep. 5, 2012

(87) PCT Pub. No.: WO2011/084658

PCT Pub. Date: Jul. 14, 2011

(65) Prior Publication Data

US 2012/0318225 A1 Dec. 20, 2012

Related U.S. Application Data

(60) Provisional application No. 61/287,370, filed on Dec. 17, 2009.

(51) Int. Cl.

| | |
|---|---|
| ***C10L 1/18*** | (2006.01) |
| ***C10L 10/18*** | (2006.01) |
| ***C10L 1/185*** | (2006.01) |
| ***C10L 1/192*** | (2006.01) |
| ***C10L 1/183*** | (2006.01) |
| ***C10L 10/04*** | (2006.01) |

(52) U.S. Cl.

CPC ..... *C10L 1/1852* (2013.01); *C10L 2300/20* (2013.01); *C10L 10/18* (2013.01); *C10L 1/192* (2013.01); *C10L 1/1835* (2013.01); *C10L 10/04* (2013.01)

USPC ..... 44/442

(58) Field of Classification Search

CPC ..... C10L 1/183; C10L 1/1832; C10L 1/1835; C07C 37/00; C07C 37/01; C07C 39/00; C07C 39/04; C07C 39/08

USPC ..... 44/450, 442; 568/716, 766

See application file for complete search history.

(56) References Cited

U.S. PATENT DOCUMENTS

| | | | | |
|---|---|---|---|---|
| 3,849,085 | A * | 11/1974 | Kreuz et al. | 44/450 |
| 4,107,054 | A | 8/1978 | Woods | |
| 5,037,567 | A | 8/1991 | Farng et al. | |
| 5,102,569 | A | 4/1992 | Onopchenko et al. | |
| 5,221,461 | A | 6/1993 | Henrici et al. | |
| 5,336,278 | A | 8/1994 | Adams et al. | |
| 5,576,274 | A | 11/1996 | Patil | |
| 5,755,835 | A * | 5/1998 | Cherpeck | 44/432 |
| 2002/0072479 | A1 | 6/2002 | Williamson et al. | |
| 2007/0137098 | A1 | 6/2007 | Martyak et al. | |

FOREIGN PATENT DOCUMENTS

| | | | |
|---|---|---|---|
| DE | 2040151 | A1 | 3/1971 |
| EP | 1188788 | A1 | 3/2002 |
| GB | 706425 | A | 3/1954 |
| WO | 2007102948 | A2 | 9/2007 |

OTHER PUBLICATIONS

Abstract of "Effect of Oligoisobutylenylphenols on Degradation of Halogen-Containing Polymers", Biglova, R.Z., et al., (Russia), Chemical Abstract Service, Columbus, Ohio, XP002629058, 1997.

Abstract of JP 11029780 A, Jul. 7, 1997, Yoshimura et al., Chemical Abstract Service, Columbus, Ohio, XP002629057.

Corresponding PCT Publication No. WO 2011/084658 A1 and Search Report published Jul. 14, 2011.

* cited by examiner

*Primary Examiner* — Cephia D Toomer

(74) *Attorney, Agent, or Firm* — Christopher p. Demas, Esq.; David M. Shold, Esq.

(57) ABSTRACT

The present invention provides a nitrogen-free fuel detergent additive, fuel additive and fuel compositions containing the same, as well as a process for making such additives, where the additive may be described as a hydrocarbyl-substituted alkyloxy and/or hydroxy aromatic compound and may be produced by the reaction of (i) an alkyloxy and/or hydroxy aromatic compound and (ii) a polyolefin containing from 4 to 350 carbon atoms, in the presence of an optional solvent and/or catalyst, wherein the resulting nitrogen free additive provides acceptable engine deposit control that is comparable and/or better than the deposit control provided by nitrogen-containing fuel additives.

10 Claims, No Drawings

NITROGEN-FREE DEPOSIT CONTROL FUEL ADDITIVES AND ONE STEP PROCESS FOR THE MAKING THEREOF

BACKGROUND OF THE INVENTION

The present invention relates to fuel additives, fuel additive compositions and fuel compositions as well as a method for fueling an internal combustion engine, providing improved deposit control inside the engine, as well as other benefits, with additives that are free of nitrogen.

Hydrocarbon-based fuels generally contain numerous deposit-forming substances. When used in internal combustion engines (ICE), deposits from these substances can form on and around constricted areas of the engine which come in contact with the fuel. In these ICE, such as automobile engines, deposits can build on engine intake valves leading to progressive restriction of the gaseous fuel mixture flow into the combustion chamber, in turn reducing the maximum power of the engine, decreasing fuel economy, increasing engine emissions, hindering engine startability, and/or affecting overall drivability.

Engines have and continue to become more sensitive to deposits due at least in part to engine designs utilizing tighter clearances with more constricted areas. A common practice is to incorporate a detergent into the fuel composition for the purpose of reducing or inhibiting the formation of, and facilitating the removal of, engine deposits. These additives improve the engine performance and reduce the engine emissions.

Generally, fuel detergent additives include additives that can be described as ashless dispersants. These additives consist of hydrocarbyl back-bones, including polyisobutylene (PIB) backbones, which traditionally have been combined with polar, nitrogen-containing head groups. The primary fuel detergent additives used today include PIB amines, PIB succinimides and PIB phenol Mannich amines. One key aspect of these fuel detergent additives is the presence of an active nitrogen-containing group, which is believed to be required for good performance of the additives.

In some cases, nitrogen-containing additives can lead to undesirable effects, such as seal degradation, particularly in the case of elastomer containing seals. Nitrogen-free additives would be free of these potential disadvantages.

There is a need for an effective fuel additive that may be used in fuel additive compositions and fuel compositions in the operation of ICEs that is free of nitrogen. There is need for such nitrogen-free additives that provide comparable and/or improved performance compared to the nitrogen-containing additives commonly used today.

SUMMARY OF THE INVENTION

A new class of fuel detergents have been discovered which offer improvements over traditional fuel detergents such as polyisobutylene (PIB) phenol Mannich detergents. This new class of detergents is substantially free of nitrogen and, in some embodiments, do not contain any nitrogen. Nitrogen has traditionally been believed to be essential to the good performance of fuel detergent additives. The additives of the present invention may be nitrogen free while still delivering comparable and/or improved performance compared to the nitrogen-containing additives commonly used today.

The present invention provides a composition comprising a nitrogen-free detergent fuel additive represented by Formula I Formula I

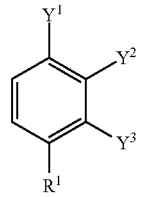

wherein: $R^1$ is a hydrocarbyl group containing from 1 or 20 to 250 or 350 carbon atoms; each $Y^1$, $Y^2$ and $Y^3$ is independently —H or —$OR^2$ where each $R^2$ is independently hydrogen or a hydrocarbyl group containing 1 to 10 carbon atoms; so long as at least two of $Y^1$, $Y^2$ and $Y^3$ are —$OR^2$ and where at least two —$OR^2$ groups are adjacent to one another; and where $R^1$ and $R^2$ are substantially free to free of nitrogen. As indicated above, each $R^2$ group may be a unique hydrocarbyl group or hydrogen, including the $R^2$ groups present in the various Y groups. In some embodiments, the $R^1$ group may be attached to any carbon atom in the ring, shown in Formula I. For examples, $R^1$ may be para to any of the Y groups present, including $Y^1$, $Y^2$ or $Y^3$. In any of these embodiments, and particularly when $R^1$ is para to $Y^2$, $R^1$ may be a hydrocarbyl group as defined above and may also be —$[R^{1a}]_n$—$COOR^{1b}$ where n is 0 or 1, $R^{1a}$ is a hydrocarbylene group and $R^{1b}$ is hydrogen or a hydrocarbyl group. $R^{1a}$ may be saturated or unsaturated. In some embodiments $R^{1a}$ is an alkylene group containing from 1 or 2 to 6 or 4 carbon atoms, and in some embodiments 2 carbon atoms.

In some embodiments the additives of the present invention are represented by Formula I wherein: a) the additive represented by Formula I wherein $Y^1$ is —$OR^2$, $Y^2$ is —$OR_2$, $Y^3$ is —H; b) the additive represented by Formula I wherein $Y^1$ is —H, $Y^2$ is —$OR^2$, $Y^3$ is —$OR^2$; c) the additive represented by Formula I wherein $Y^1$ is —$OR^2$, $Y^2$ is —$OR^2$, $Y^3$ is —$OR^2$; or mixtures thereof. In any of these embodiments $R^1$ may be derived from polyisobutylene having a number average molecular weight of 350 to 3000.

In some embodiments the additives of the present invention are represented by Formula I wherein: a) the additive represented by Formula I wherein $Y^1$ is —OH, $Y^2$ is —OH, $Y^3$ is —H; b) the additive represented by Formula I wherein $Y^1$ is —H, $Y^2$ is —OH, $Y^3$ is —OH; c) the additive represented by Formula I wherein $Y^1$ is —OH, $Y^2$ is —OH, $Y^3$ is —OH; or mixtures thereof. In any of these embodiments $R^1$ may be derived from polyisobutylene having a number average molecular weight of 350 to 3000.

The present invention also provides for a fuel additive composition and/or concentrate comprising: one or more of the nitrogen-free detergent additives described herein; an optional solvent; and one or more optional additional performance additives.

The present invention also provides for a fuel composition comprising: one or more of the nitrogen-free detergent additives described herein; a fuel; and one or more optional additional performance additives.

The present invention also provides for a method of operating an internal combustion engine, which includes the step of supplying to said engine a fuel composition comprising one or more of the nitrogen-free detergent additives described herein; a fuel; and one or more optional additional performance additives.

The present invention also provides for a process for making the nitrogen-free detergent fuel additives of the present invention including the steps of reacting (a) a compound represented by Formula II;

Formula II

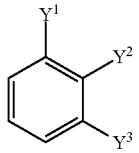

wherein each $Y^1$, $Y^2$ and $Y^3$ is independently —H or —$OR^2$ where each $R^2$ is independently hydrogen or a hydrocarbyl group containing 1 to 10 carbon atoms; so long as at least two of $Y^1$, $Y^2$ and $Y^3$ are —$OR^2$ and where at least two —$OR^2$ groups are adjacent to one another; and each $R^2$ is free of nitrogen; and (b) a polyolefin compound containing from 4 to 350 carbon atoms wherein the polyolefin is nitrogen free; wherein the reaction is optionally carried out in the presence of a solvent and a catalyst.

DETAILED DESCRIPTION OF THE INVENTION

Various preferred features and embodiments will be described below by way of non-limiting illustration.

Field of the Invention

The present invention involves a fuel additive, a fuel additive composition, a fuel composition and a method for fueling an internal combustion engine, where the fuel additive is free of nitrogen.

The fuel additive composition of the invention shows comparable and/or improved engine deposit control, allowing for improved engine performance, including but not limited to reductions in deposit-caused engine power losses, reduction in deposit-caused fuel economy losses and decreases in deposit-caused engine emissions. The fuel detergent additive may also be used as a corrosion inhibitor or a lubricity aid.

The Nitrogen Free Additive

The nitrogen-free fuel detergent additives of the present invention have been shown to effectively control the formation of engine deposits, including intake valve deposits. This result is unexpected as it is generally believed that a nitrogen-containing polar group is required for a fuel additive to provide effective deposit control in an engine. While not wishing to be bound by theory, the polar nitrogen-containing group is believed to be necessary for good performance as the polar head may effectively associate with dirt and/or deposit particles in an engine, allowing them to be dispersed by the fuel additive and facilitate for their removal from, and/or prevent their initial deposit on, engine surfaces. With no polar group present, it is believed the additive would be much less effective at associating with dirt and deposit particles in the engine, and so would be much less effective at controlling engine deposits.

The present invention provides nitrogen-free fuel detergent additives that are effective at controlling engine deposits, despite the fact that they are free of nitrogen, and so free of any polar nitrogen-containing groups.

While not wishing to be bound by theory, it is believed that the nitrogen-free fuel detergent additives provide effective deposit control due, at least in part, to the proximity of the ortho-polar group in the adjacent position to the phenolic (or cresol) hydroxyl group or ether, as illustrated in Formula I shown above.

The fuel detergent additives of the present invention may be described as a hydrocarbyl-substituted alkoxy and/or hydroxy aromatic compound. These compounds may be prepared by reacting (i) an alkoxy and/or hydroxy aromatic compound and (ii) a polyolefin containing from 4 to 350 carbon atoms, in the presence of an optional solvent and/or catalyst.

The fuel detergent additive of the present invention may be represented by Formula I, shown above, wherein: each $Y^1$, $Y^2$ and $Y^3$ is independently —H or —$OR^2$; each $R^2$, including the $R^2$ groups which may be present in $Y^1$, $Y^2$ and/or $Y^3$, is independently hydrogen or a hydrocarbyl group containing 1 to 50, 1 to 25, 1 to 10, or 1 to 6 carbon atoms. In some embodiments each of the $R^2$ groups present in the $Y^1$, $Y^2$ and/or $Y^3$ groups is independently hydrogen or a hydrocarbyl group containing 1 to 10, or 1 to 6 carbon atoms, and in some embodiments each $R^2$ group is hydrogen. $R^1$ is a hydrocarbyl group containing from 4, 10, or 50 to 350, 250, or 150 carbon atoms. In some embodiments, the $R^2$ groups described above may also be a —$(R^3)_m$—$OR^4$ group wherein $R^3$ is a hydrocarbyl group, and in some embodiments an alkylene group, containing 1 to 10 carbon atoms, $R^4$ is hydrogen or a hydrocarbyl group containing 1 to 50 carbon atoms, and m is 0 or 1. In all of the embodiments above, each and every one of the $R^1$, $R^2$, $R^3$ and $R^4$ groups and/or each of the hydrocarbyl groups described may be free of nitrogen.

The additives of the present invention have at least two —$OR^2$ groups present as substituent groups on the ring of the aromatic compound. In some embodiments there may be three —$OR^2$ groups present. Also in any of the embodiments described above, at least two of the —$OR^2$ groups present may be adjacent to each other, that is attached to carbon atoms in the aromatic ring which are next to each other. For example, the —$OR^2$ groups may be present in positions 1 and 2, 2 and 3, or 1, 2 and 3 on the aromatic ring, thus providing at least two —$OR^2$ groups that are adjacent to one another. While not wishing to be bound by theory it is believed that the proximity of the substituent groups is an important feature that impacts the performance of these additives.

In some embodiments the nitrogen free additive of the present invention may be represented by Formula III shown below:

Formula III

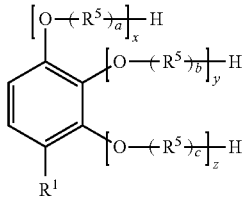

wherein: $R^1$ is a hydrocarbyl group, in some embodiments as defined above; each $R^5$ is independently a hydrocarbylene group containing 1 to 50, 1 to 25, 1 to 10, or 1 to 6 carbon atoms; a, b and c are each independently 0 or 1; x, y and z are each independently 0 or 1; and each and every $R^1$ and $R^5$ are substantially free or free of nitrogen; so long as the additive contains at least two substituent groups (that is not merely an —H) other than $R^1$ and where the two substituent groups are adjacent to one another. In some embodiments, the $R^1$ group may be attached to any carbon atom in the ring, shown in Formula III. For examples, $R^1$ may be para to any of the substituent groups present. In any of these embodiments, and particularly when $R^1$ is para to the —$[O—(R^5)_b]_y$—H group, $R^1$ may be a hydrocarbyl group as defined above and may also be —$[R^1]_n$—$COOR^{1b}$ where n is 0 or 1, $R^{1a}$ is a hydrocarbylene group and $R^{1b}$ is hydrogen or a hydrocarbyl group. $R^{1a}$ may be saturated or unsaturated. In some embodiments $R^{1a}$ is an alkylene group containing from 1 or 2 to 6 or 4 carbon atoms, and in some embodiments 2 carbon atoms.

In some embodiments, the additive may be represented by any of the formulae provided above wherein $R^1$ is a polyisobutylene group derived from polyisobutylene having a number average molecular weight of 350 to 5000, or 500 to 2500, 550 to 2000, or 750 to 1100.

The hydrocarbyl and hydrocarbylene groups referred to above in any of the described embodiments are not particularly limited. Suitable groups include polyolefins prepared by polymerizing olefin monomers by well known polymerization methods that are also commercially available. Suitable olefin monomers include monoolefins, including monoolefins having 2 to 10 carbon atoms such as ethylene, propylene, 1-butene, isobutylene, and 1-decene. An especially useful monoolefin source is a $C_4$ refinery stream having a 35 to 75 weight percent butene content and a 30 to 60 weight percent isobutene content. Useful olefin monomers also include diolefins such as isoprene and 1,3-butadiene. Olefin monomers can also include mixtures of two or more monoolefins, of two or more diolefins, or of one or more monoolefins and one or more diolefins. Useful polyolefins include polyisobutylenes having a number average molecular weight of 140 to 5000, in another instance of 400 to 2500, and in a further instance of 140 or 500 to 1500 or 1100. In other embodiments $R^1$ may be described as a polyisobutylene group derived from polyisobutylene with a molecular weight of 350 to 5000, 500 to 2500 or 750 to 1200. The polyisobutylene can have a vinylidene double bond content of 5 to 69%, in a second instance of 50 to 69%, and in a third instance of 50 to 95%. The polyolefin can be a homopolymer prepared from a single olefin monomer or a copolymer prepared from a mixture of two or more olefin monomers. Also possible as the hydrocarbyl substituent source are mixtures of two or more homopolymers, two or more copolymers, or one or more homopolymers and one or more copolymers.

In one embodiment, the vinylidene content of the $R^1$ hydrocarbyl group in Formula I and/or Formula III can comprise at least about 30 mole % vinylidene groups, at least about 50 mole % vinylidene groups, or at least about 70 mole % vinylidene groups. Such material and methods for preparing them are described in U.S. Pat. Nos. 5,071,919; 5,137,978; 5,137,980; 5,286,823, 5,408,018, 6,562,913, 6,683,138, 7,037,999 and U.S. Publication Nos. 20040176552A1, 20050137363 and 20060079652A1, which are expressly incorporated herein by reference. Such products are commercially available from BASF, under the tradename GLISSOPAL® and from Texas Petrochemicals LP, under the tradename TPC 1105™ and TPC 595™.

In still other embodiments $R^1$ hydrocarbyl group in Formula I and/or Formula III can comprise a polyisobutylene substituent derived from a conventional PIB and a high vinylidene PIB with a number average molecular weight as described above.

A conventional PIB can be characterized as having a major amount of a trisubstituted double bond isomer ($—C(CH_3)_2C(CH_3)=CHCH_3$) and minor amounts of a tetrasubstituted double bond isomer and of an alpha- and/or beta-vinylidene double bond isomer. Conventional PIBs generally can contain a) 45 mole % or greater, 50 mole % or greater, 55 mole % or greater, 45 to 85 mole %, 50 to 75 mole %, or 55 to 70 mole % of trisubstituted double bond isomer, b) 5 to 45 mole %, 10 to 35 mole %, 15 to 30 mole %, or 20 to 25 mole % of tetrasubstituted double bond isomer, c) 30 mole % or less, 25 mole % or less, 1 to 30 mole %, 2 to 30 mole %, or 5 to 25 mole % of alpha- and/or beta-vinylidene double bond isomer, and can have d) a 1.1 to 4, 1.2 to 3.5, or 1.5 to 3 polydispersity defined as the ratio of weight average molecular weight to number average molecular weight. In an embodiment of the invention the conventional PIB has a vinylidene double bond isomer content as described above that comprises the alpha-vinylidene double bond isomer. Conventional PIBs are prepared by polymerizing isobutylene or an isobutylene containing composition, such as a $C_4$ hydrocarbon stream from a petroleum catalytic cracking unit, with an active acidic polymerization catalyst such as $AlCl_3$. Conventional PIBs are available commercially under numerous trade names including Parapol® from Exxon and Lubrizol® 3104 from Lubrizol.

A high vinylidene PIB can be characterized as having a major amount of an alpha- and/or beta-vinylidene double bond isomer (respectively $—CH_2C(CH_3)=CH_2$ and/or $—CH=C(CH_3)_2$) and minor amounts of other isomers including a tetrasubstituted double bond isomer. Because of their high vinylidene double bond isomer content, high vinylidene PIBs are considered to be more reactive and to undergo a higher conversion to derivatives which are better performers in comparison to derivatives from conventional PIBs. High vinylidene PIBs generally can contain a) 70 mole % or greater, 80 mole % or greater, 90 mole % or greater, 70 to 99.9 mole %, 80 to 99.5 mole %, or 85 to 99 mole % of alpha- and/or beta-vinylidene double bond isomer, b) 0.1 to 15 mole %, 0.5 to 12 mole %, or 1 to 10 mole % of tetrasubstituted double bond isomer, and can have c) a 1.0 or 1.1 to 3.5, a 1.2 to 3, or a 1.3 to 2.5 polydispersity. In an embodiment of the invention the high vinylidene PIB can have an alpha-vinylidene double bond isomer content of 75 to 95 mole % or 80 to 90 mole %, and in another embodiment the high vinylidene PIB can have an alpha-vinylidene double bond isomer content of 50 to 70 mole % or 55 to 65 mole %. High vinylidene PIBs are prepared by polymerizing isobutylene or an isobutylene containing composition with a milder acidic polymerization catalyst such as $BF_3$. High vinylidene PIBs are available commercially from several producers to include BASF and Texas Petrochemicals.

The polyisobutylene from which the polyisobutylene substituent is derived can have a) an alpha- and/or beta-vinylidene double bond isomer content of 97 mole % or less, 85 mole % or less, 75 mole % or less, less than 70 mole %, 50 to 95 or 97 mole %, 55 to 80 mole %, 60 to 75 mole %, or 55 to 69 mole %, b) a trisubstituted double bond isomer content of 4 or 5 to 40 mole %, 10 to 30 mole %, or 15 to 25 mole %, c) a tetrasubstituted double bond isomer content of 5 to 20 mole %, 6 to 18 mole %, or 7 to 15 mole %, and can have d) a polydispersity of 1.1 to 3.8, 1.2 to 3.5, or 1.3 to 2.8.

In one embodiment of the invention the PIB can generally have 50 to 95 mole % of alpha- and/or beta-vinylidene double bond isomer and 4 to 40 mole % of trisubstituted double bond isomer, and in other embodiments can have 60 to 75 or 55 to 69 mole % of alpha- and/or beta-vinylidene double bond isomer and 15 to 25 mole % of trisubstituted double bond isomer. In a further embodiment of the invention the PIB of the PIB alkylated hydroxyaromatic compound is derived from a conventional PIB and high vinylidene PIB where the weight ratio of conventional PIB to high vinylidene PIB is respectively 0.1:99.9 to 99.9:0.1, 15:85 to 60:40, or 25:75 to 40:60.

In some embodiments the fuel detergents of the present invention are soluble and/or stably dispersible in fuel compositions. Thus, for example, compositions intended for use in fuels are typically fuel-soluble and/or stably dispersible in a fuel in which they are to be used. The term "fuel-soluble" as used in this specification and appended claims does not necessarily mean that all the compositions in question are miscible or soluble in all proportions in all fuels. Rather, it is intended to mean that the composition is soluble in a fuel (hydrocarbon, non-hydrocarbon, mixtures, etc) in which it is intended to function to an extent which permits the solution to exhibit one or more of the desired properties. Similarly, it is not necessary that such "solutions" be true solutions in the strict physical or chemical sense. They may instead be microemulsions or colloidal dispersions which, for the purpose of this invention, exhibit properties sufficiently close to those of true solutions to be, for practical purposes, interchangeable with them within the context of this invention.

As previously indicated, the nitrogen-free fuel detergent additives of this invention are useful as additives for fuels, in which they may function as detergents. The fuel detergents of the present invention can be present in fuel compositions at 1 to 10,000 ppm (where ppm is calculated on a weight:weight basis). In additional embodiments, the fuel detergent is present in fuel compositions in ranges with lower limits of 1, 5, 10, 20, 50, 100, 150 and 200 ppm and upper limits of 10,000, 5,000, 2,500, 1,000, and 500 where any upper limit may be combined with any lower limit to provide a range for the fuel detergent present in the fuel compositions. In one embodiment the fuel detergent is present at 10 to 2500 ppm, and in another embodiment from 20-500 ppm.

The additives of the present invention, in some embodiments, are not borated and are substantially free of Boron, in the same way that the additives of substantially free of Nitrogen.

Method of Making the Additives

Other nitrogen free additives may be prepared by reacting a hydrocarbyl-substituted hydroxy aromatic compound with an aldehyde, optionally in the presence of a base catalyst. In some embodiments the hydrocarbyl-substituted hydroxy aromatic compound is a hydrocarbyl phenol, a hydrocarbyl cresol, or a mixture thereof. This method of preparation generally requires multiple steps: a step to alkylate a hydroxy aromatic compound in order to prepare the hydrocarbyl-substituted hydroxy aromatic compound, and a second step to react the hydrocarbyl-substituted hydroxy aromatic compound with an aldehyde to add the substituent group adjacent and/or near to the existing ortho-polar group on the ring.

However, the additives of the present invention are prepared by an improved one step process for preparing the nitrogen free additives of the present invention. In these embodiments the nitrogen free additives of the present invention is prepared by reacting a substituted aromatic compound with a polyalkene. The reaction may optionally be carried out in the presence of a solvent as well as a catalyst. When a catalyst is used, a deactivator may be added at the end of the reaction. The resulting product may be filtered. This one step process results in the nitrogen free additives of the present invention.

In one embodiment, substituted aromatic compound is a hydroxy substituted aromatic compound, an ether and/or alkoxy substituted aromatic compound, or combination thereof. In some embodiments the aromatic compound of the present invention includes at least two substituent groups where the substituent groups are —OH, —OR, or a combination thereof, wherein R is a hydrocarbyl group. In some embodiments R contains from 1 to 10, 6 or even 4 carbon atoms. Within any of the aromatic compounds described herein, the substituent groups are typically adjacent to one another or may have one open position between them. For example, the substituent groups may be present in positions 1 and 2, 1 and 3 or 1, 2 and 3 on the aromatic ring of the compound.

In some embodiments the aromatic compound is a hydroxy aromatic compound, and more specifically, a polyhydroxy aromatic compound, including both dihydroxy and trihydroxy aromatic compounds. In one embodiment the hydroxy aromatic compound is pyrocatechol, resorcinol, pyrogallol, or a combination thereof.

In some embodiments the aromatic compound is an ether-containing aromatic compound, and more specifically, a polyether aromatic compound. In one embodiment the hydroxy aromatic compound is 1,2-dimethoxybenzene, 1,3-dimethoxybenzene, 1,2,3 trimethoxybenzene. In still other embodiments, the aromatic compounds of the present invention contains two or three substituents groups where each substituents group is independently a hydroxyl group, a methoxy group, an ethoxy group, a propoxy group, a butoxy group, a pentoxy-group, a hexoxy group, or combinations thereof.

The polyalkene used to prepare the nitrogen free additives of the present invention generally attaches in the para position, or, as in line with the position description for the substituent groups above, position 4 on the aromatic ring of the compound (however the group may also be present in position 3, depending on the identity of the $Y^1$ group). During the reaction the polyalkene attaches to the aromatic ring of the compound, forming a hydrocarbyl substituent group, represented by $R^1$ in Formula I and Formula III shown above. The polyalkene, and so the resulting hydrocarbyl group, generally contains an average of at least 4, 8, 30, or 35 up to 350, or to 200, or to 100 carbon atoms. The polyalkene may also contain any of the carbon atom ranges or average molecular weights described above for group $R^1$, and may comprise conventional polyisobutylene, highly reactive polyisobutylene, or combinations thereof.

Suitable polyalkenes also include homopolymers and interpolymers of polymerizable olefin monomers of 2 to 16 or to 6, or to 4 carbon atoms. The olefins may be monoolefins such as ethylene, propylene, 1-butene, isobutylene, and 1-octene; or a polyolefinic monomer, such as diolefinic monomer, such 1,3-butadiene and isoprene. In one embodiment, the interpolymer is a homopolymer. An example of a polymer is a polybutene. In one instance at least or about 50% of the polybutene is derived from isobutylene. The polyalkenes are prepared by conventional procedures.

In one embodiment, the $R^1$ hydrocarbyl group is derived from polyalkenes having a number average molecular weight of least 250, 350, 500, or 750 up to 5000, or to 3000, or to 2000, or to 1500. In some embodiments the polyalkene is polyisobutylene with a molecular weight of 800 to 1200.

The aromatic compound used to prepare the nitrogen free additives of the present invention may include polyhydroxy benzenes, an alkyl-substituted polyhydroxy benzene such as 3-methylcatechol, or mixtures thereof. In some embodiments mono-hydroxy aromatic compounds may also be present, in small amounts. In other embodiments no mono-hydroxy aromatic compounds are present in the materials used to prepare the present additives.

The reactants used in the presence invention may be mixed in a solvent, such as toluene to improve their handling and ease the mixing of the reaction system. Such a solvent may be separately added to the reactants and/or added directly to the reaction system.

As noted, the one step process of the present invention may be carried out in the presence of a catalyst, such as an acidic catalyst. The acidic catalyst can include for example mineral acids such as a sulfuric acid acidified clay, Lewis acid catalysts such as a complex of boron trifluoride with diethyl ether or with phenol, and acidic ion exchange resins such as the Amberlyst® series of strongly acidic macroreticular resins available from Rohm and Haas. The catalyst is not overly limited and may include an esterification catalyst such as toluenesulfonic acid, sulfuric acid, aluminum chloride, boron trifluoride-triethylamine, methanesulfonic acid, hydrochloric acid, ammonium sulfate, phosphoric acid, sodium methoxide and the like.

The compound of formulae I and III may be prepared by reacting a hydrocarbyl-substituted hydroxy aromatic compound with an aldehyde, optionally in the presence of a base catalyst. In different embodiments the hydrocarbyl-substituted hydroxy aromatic compound is a hydrocarbyl phenol, a hydrocarbyl cresol, or a mixture thereof. This method of preparation generally requires multiple steps: a step to alkylate a hydroxy aromatic compound in order to prepare the hydrocarbyl-substituted hydroxy aromatic compound, and a second step to react the hydrocarbyl-substituted hydroxy aromatic compound with an aldehyde to add the substituent group adjacent and/or near to the existing ortho-polar group on the ring. The mole percent of the compound of formulae I or III formed by reacting the hydrocarbyl-substituted hydroxy aromatic compound with the aldehyde may be 10 mol % to 100 mol %, or 25 mol % to 99 mol %, or 50 mol % to 99 mol %.

The additives of the present invention, in some embodiments, are not borated and the process is substantially free of boron, in the same way that the additives of substantially free of nitrogen.

The Fuel Additive Compositions

The fuel additive composition of the present invention comprises the nitrogen-free fuel detergent additive described herein and further comprises a solvent and/or one or more additional performance additives. These additive compositions, also known as concentrates, may be used to prepare fuel compositions by adding the additive composition to a fuel.

The solvents suitable for use in the present invention include hydrocarbon solvents that provide for the additive composition's compatibility and/or homogeneity and to facilitate their handling and transfer and may include a fuel as described below. The solvent can be an aliphatic hydrocarbon, an aromatic hydrocarbon, an oxygen-containing composition, or a mixture thereof. In some embodiments the flash point of the solvent is generally about 25° C. or higher. In some embodiments the hydrocarbon solvent is an aromatic naphtha having a flash point above 62° C. or an aromatic naphtha having a flash point of 40° C. or a kerosene with a 16% aromatic content having a flash point above 62° C.

Aliphatic hydrocarbons include various naphtha and kerosene boiling point fractions that have a majority of aliphatic components. Aromatic hydrocarbons include benzene, toluene, xylenes and various naphtha and kerosene boiling point fractions that have a majority of aromatic components. Alcohols are usually aliphatic alcohols having about 2 to 10 carbon atoms and include ethanol, 1-propanol, isopropyl alcohol, 1-butanol, isobutyl alcohol, amyl alcohol, and 2-methyl-1-butanol.

The oxygen containing composition can include an alcohol, a ketone, an ester of a carboxylic acid, a glycol and/or a polyglycol, or a mixture thereof. The solvent in an embodiment of the invention will be substantially free of to free of sulphur having a sulphur content in several instances that is below 50 ppm, 25 ppm, below 18 ppm, below 10 ppm, below 8 ppm, below 4 ppm, or below 2 ppm. The solvent can be present in the additive concentrate composition at 0 to 99 percent by weight, and in other instances at 3 to 80 percent by weight, or 10 to 70 percent by weight. The fuel additive of the present invention and the additional performance additives taken separately or in combination can be present in the additive concentrate composition at 0.01 to 100 percent by weight, and in other instances can be present at 0.01 to 95 percent by weight, at 0.01 to 90 percent by weight, or at 0.1 to 80 percent by weight.

As allowed for by the ranges above, in one embodiment, the additive concentrate may comprise the fuel detergent of the present invention and be substantially free of any additional solvent. In these embodiments the additive concentrate containing the fuel detergent of the present invention is neat, in that it does not contain any additional solvent added to improve the material handling characteristics of the concentrate, such as its viscosity. However, in other embodiments, the additive concentrate containing the additive of the present invention does contain some solvent.

In an embodiment of the invention the additive concentrate composition, or a fuel composition containing the fuel detergent of the present invention, may be prepared by admixing or mixing the components of the composition at ambient to elevated temperatures usually up to 60° C. until the composition is homogeneous.

In some embodiments the fuel additive composition is substantially nitrogen free or nitrogen free. In other embodiments the fuel additive composition comprises the nitrogen free fuel additive described above but also comprises additional additive which may not be nitrogen free.

The additional performance additives which may be included in the additive compositions of the present invention are described below.

The Fuel

The fuel composition of the present invention comprises the fuel detergent described above and a liquid fuel, and is useful in fueling an internal combustion engine. A fuel may also be a component of the additive compositions described above.

Fuels suitable for use in the present invention are not overly limited. Generally, suitable fuels are normally liquid at ambient conditions e.g., room temperature (20 to 30° C.). The liquid fuel can be a hydrocarbon fuel, a non-hydrocarbon fuel, or a mixture thereof.

The hydrocarbon fuel can be a petroleum distillate, including a gasoline as defined by ASTM specification D4814, or a diesel fuel, as defined by ASTM specification D975. In one embodiment the liquid fuel is a gasoline, and in another embodiment the liquid fuel is a non-leaded gasoline. In another embodiment the liquid fuel is a diesel fuel. The hydrocarbon fuel can be a hydrocarbon prepared by a gas to liquid process to include for example hydrocarbons prepared by a process such as the Fischer-Tropsch process.

The non-hydrocarbon fuel can be an oxygen containing composition, often referred to as an oxygenate, which includes an alcohol, an ether, a ketone, an ester of a carboxylic acid, a nitroalkane, or a mixture thereof. The non-hydrocarbon fuel can include for example methanol, ethanol, butanol, methyl t-butyl ether, methyl ethyl ketone, transesterified oils and/or fats from plants and animals such as rapeseed methyl ester and soybean methyl ester, and nitromethane.

Mixtures of hydrocarbon and non-hydrocarbon fuels can include, for example, gasoline and methanol and/or ethanol, diesel fuel and ethanol, and diesel fuel and a transesterified plant oil such as rapeseed methyl ester and other bio-derived fuels. In one embodiment the liquid fuel is an emulsion of water in a hydrocarbon fuel, a non-hydrocarbon fuel, or a mixture thereof. In several embodiments of this invention the liquid fuel can have a sulphur content on a weight basis that is 5000 ppm or less, 1000 ppm or less, 300 ppm or less, 200 ppm or less, 30 ppm or less, or 10 ppm or less.

In some embodiments the fuel composition is substantially nitrogen free or nitrogen free. In other embodiments the fuel composition comprises the nitrogen free fuel additive described above but also comprises additional additive which may not be nitrogen free.

The liquid fuel of the invention is present in a fuel composition in a major amount that is generally greater than 95% by weight, and in other embodiments is present at greater than 97% by weight, greater than 99.5% by weight, or greater than 99.9% by weight.

Additional Performance Additives

The additive compositions and fuel compositions of the present invention can further comprise one or more additional performance additives. Additional performance additives can be added to a fuel composition depending on several factors to include the type of internal combustion engine and the type of fuel being used in that engine, the quality of the fuel, and the service conditions under which the engine is being operated. In some embodiments the additional performance additives added are free of nitrogen. In other embodiments, the additional performance additives may contain nitrogen.

The additional performance additives can include: an antioxidant such as a hindered phenol or derivative thereof and/or a diarylamine or derivative thereof; a corrosion inhibitor such as an alkenylsuccinic acid; and/or a detergent/dispersant additive, other than the fuel detergent of the present invention, such as a polyetheramine or nitrogen containing detergent, including but not limited to PIB amine dispersants, quaternary salt dispersants, and succinimide dispersants.

The additional performance additives may also include: a cold flow improver such as an esterified copolymer of maleic anhydride and styrene and/or a copolymer of ethylene and vinyl acetate; a foam inhibitor such as a silicone fluid; a demulsifier such as a polyoxyalkylene and/or an alkyl polyether alcohol; a lubricity agent such as a fatty carboxylic acid; a metal deactivator such as an aromatic triazole or derivative thereof, including but not limited to a benzotriazole such as tolytriazole; and/or a valve seat recession additive such as an alkali metal sulfosuccinate salt. The additional additives may also include a biocide; an antistatic agent, a deicer, a fluidizer such as a mineral oil and/or a poly(alpha-olefin) and/or a polyether, and a combustion improver such as an octane or cetane improver.

The additional performance additives which may be present in the fuel additive compositions and fuel compositions of the present invention also include di-ester, di-amide, ester-amide, and ester-imide friction modifiers prepared by reacting a dicarboxylic acid (such as tartaric acid) and/or a tricarboxylic acid (such as citric acid), with an amine and/or alcohol, optionally in the presence of a known esterification catalyst. These friction modifiers, often derived from tartaric acid, citric acid, or derivatives thereof, may be derived from amines and/or alcohols that are branched so that the friction modifier itself has significant amounts of branched hydrocarbyl groups present within it structure. Examples of a suitable branched alcohols used to prepare these friction modifiers include 2-ethylhexanol, isotridecanol, Guerbet alcohols, or mixtures thereof.

The additional performance additives can each be added directly to the additive and/or the fuel compositions of the present invention, but they are generally mixed with the nitrogen-free fuel detergent additive to form an additive composition, or concentrate, which is then mixed with fuel to result in a fuel composition. The additive concentrate compositions are described in more detail above.

INDUSTRIAL APPLICATION

In one embodiment the invention is useful for a liquid fuel and/or for an internal combustion engine, including either compression ignition engines or spark ignited engines. The internal combustion engine includes 2-stroke or 4-stroke engines fuelled with gasoline, diesel, a natural gas, a mixed gasoline/alcohol or any of the fuels described in the sections above. The compression ignition engines include both light duty and heavy duty diesel engines. The spark ignited engines include direct injection gasoline engines.

In other embodiments the invention is useful in additive compositions in that the fuel detergent described above provides improved engine deposit control, allowing for improved engine performance, including but not limited to reductions in deposit-caused engine power losses, reduction in deposit-caused fuel economy losses and decreases in deposit-caused engine emissions.

In still other embodiments the additive compositions of the present invention may be used in a lubricating composition such that the additives are present in the lubricating system of the engine. The additives may also enter the combustion chamber of the engine during operation of the engine by the transfer of small amounts of the additive containing lubricating composition to the combustion chamber due to a phenomenon referred to as "blow by" where the lubricating composition, and in this case the additive composition, pass around the piston heads inside the cylinder, moving from the lubricating system of the engine into the combustion chamber.

As used herein, the term "nitrogen free" is used in its ordinary sense and means that the fuel detergent additive of the present invention contains only small amounts of nitrogen, is substantially free of nitrogen, or even contains no nitrogen atoms. The invention is not limited to nitrogen-free compositions, as other nitrogen-containing substances may be added to compositions that include the nitrogen-free fuel detergent described herein. However, in some embodiments, the nitrogen content of the additive compositions and/or the fuel compositions of the present invention are less than 100 ppm, less than 50 ppm, less than 35 ppm or less than 10 ppm (where ppm is calculated on a weight: weight basis). In still other embodiments, the additive and/or fuel compositions of the present invention are free of nitrogen. It should also be clear that the additives of the present invention may contain small amounts of nitrogen and/or nitrogen-containing materials at trace and/or contaminant levels that do not impact the performance of the additives of the present invention or the compositions containing such additives. In some embodiments, the additives of the present invention are substantially free of nitrogen in that they contain on average less than 1, 0.5 or even 0.2 or 0.1 nitrogen atoms per molecule. In other embodiments, the additives of the present invention are substantially free of nitrogen in that they contribute no more than 50, 10, 5, 1 or even 0.1 ppm (on a weight basis) of nitrogen to any finished fuel composition in which they are used. In still other embodiments the additives of the present invention are substantially free of nitrogen in that they contribute no nitrogen to any finished fuel composition in which they are used and/or contain no nitrogen atoms.

As used herein, the term hydrocarbyl and/or hydrocarbylene, particularly when used to refer to a substituent and/or group, is used in its ordinary sense, which is well-known to those skilled in the art. Specifically, it refers to a group having a carbon atom directly attached to the remainder of the molecule and having predominantly hydrocarbon character. Examples of such groups include: hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

The invention will be further illustrated by the following examples, which sets forth particularly advantageous embodiments. While the examples are provided to illustrate the present invention, they are not intended to limit it.

Example 1

A nitrogen free additive is prepared by adding pyrocatechol (330 g; 3 moles), mixed with toluene (302 g), to a 2-liter glass reaction flask equipped with cold water condenser, caustic scrubber, subline addition tube, thermo-couple, and over head mechanical stirrer. The mixture is stirred for 15 minutes under a nitrogen blanket. The catalyst $BF_3$ etherate (20.6 g; 0.145 moles) is added dropwise over 30 minutes while maintaining the reaction temperature below 25 degrees C. Mixed vinylidene 1000 Mn polyisobutylene, TPC 1105™ available from the Texas Petrochemicals LP, (501 g; 0.50 moles) is mixed with toluene (202 g), is then added drop wise over a 3 hour period maintaining the reaction temperature below 25 degrees C. The mixture is then stirred for 22 hours at 20 to 25 degrees C. Calcium hydroxide (32.3 g; 0.436 moles) is then added to quench the catalyst. The reaction mixture is then filtered and vacuum stripped to remove the solvent. The resulting product is a polyisobutylene pyrocatechol, a nitrogen free additive.

Example 2

A nitrogen free additive is prepared by adding pyrogallol (60 g; 0.476 moles), mixed with toluene (70 g), to a 1-liter glass reaction flask equipped with cold water condenser, caustic scrubber, subline addition tube, thermo-couple, and over head mechanical stirrer. The mixture is stirred for 15 minutes under a nitrogen blanket. The catalyst $BF_3$ etherate (7.27 g; 0.051 moles) is added dropwise over 30 minutes while maintaining the reaction temperature below 25 degrees C. Mixed vinylidene 1000 Mn polyisobutylene, TPC 1105™ available from the Texas Petrochemicals LP, (183 g; 0.183 moles) mixed with toluene (150 g), is then added dropwise over an 100 minute period maintaining the reaction temperature below 25 degrees C. The mixture is then stirred for 24 hours at 20 to 25 degrees C. Calcium hydroxide (15 g; 0.2 moles) is then added to quench the catalyst. The reaction mixture is then filtered and vacuum stripped to remove the solvent. The resulting product is a polyisobutylene pyrogallol nitrogen free additive.

Example 3

A nitrogen free additive is prepared by adding pyrocatechol (330 g; 3.0 moles), mixed with toluene (520 g), to a 5-liter glass reaction flask equipped with cold water condenser, caustic scrubber, subline addition tube, thermocouple, and over head mechanical stirrer. The mixture is stirred for 15 minutes under a nitrogen blanket. The catalyst $BF_3$ etherate (55.6 g; 0.39 moles) is added dropwise over 30 minutes while maintaining the reaction temperature below 25 degrees C. Mixed vinylidene 1000 Mn polyisobutylene, TPC 1105™ available from the Texas Petrochemicals LP, (1999.7 g; 2.00 moles) mixed with toluene (975 g), is then added drop wise over a 3 hour period maintaining the reaction temperature below 25 degrees C. The mixture is then stirred for 22 hours at 20 to 25 degrees C. Calcium hydroxide (96 g; 1.30 moles) is then added to quench the catalyst. The reaction mixture is then filtered and vacuum stripped to remove the solvent. The resulting product is a polyisobutylene pyrocatechol nitrogen free additive

Comparative Example 1

To a first reaction vessel equipped with overhead mechanical mixing, heating and cooling capabilities, vacuum and nitrogen facilities and suitable overheads to cope with distillation of toluene and phenol and to handle $BF_3$ gas, 562 pbw molten phenol, mixed with toluene, is added. 18.5 pbw of catalyst ($BF_3$ gas) is added at a rate adjusted to keep the reaction vessel temperature between 23 and 27 degrees C. 1300 pbw mixed vinylidene 1000 Mn polyisobutylene, TPC 1105™ available from the Texas Petrochemicals LP, mixed with toluene, is then added to the reaction vessel at a rate adjusted to keep the reaction vessel temperature between 23 and 27 degrees C. After the feed, the mixture is held with stirring for 8 hours. 58.6 pbw calcium hydroxide and 10 pbw of an 0.88 aqueous ammonia solution is added and the mixture is then mixed for 6 hours. The resulting material is then filtered and vacuum stripped to remove the solvent and any residual phenol. The resulting material, 1424 pbw of a polyisobutylene phenol, is then added to a second reaction vessel, equipped as the first vessel described above.

In the second reaction vessel, the 1424 pbw of a polyisobutylene phenol is mixed with 121.7 pbw Solvesso™ 105, holding the material at our below 27 degrees C. Then 65.9 pbw of a 37 wt % aqueous formaldehyde solution (Formalin) is added over 35 minutes. Then 95.0 pbw of a 40% aqueous solution of dimethylamine is added to the mixture at a rate adjusted to keep the reaction vessel temperature below 40 degrees C. After the feed is complete, the reaction mixture is heated to 105 degrees C., and then slowly to 103 degrees C. as reflux allowed, removing water from the system and returning solvent by use of a Dean Stark trap. The material is then vacuum stripped to remove any remaining trace of water. The resulting material is a polyisobutylene phenol Mannich dimethylamine product, at approximately 85% wt actives in Solvesso™ 15.

Comparative Example 2

Comparative example 2 is prepared by adding ortho-cresol (1820 g; 16.85 moles), mixed with toluene (860 g; 9.3 moles), to a 10-liter glass reaction flask equipped with cold water condenser, caustic scrubber, subline addition tube, thermocouple, and over head mechanical stirrer. The mixture is stirred for 15 minutes under a nitrogen blanket. The catalyst $BF_3$ gas (42 g; 0.62 moles) is added dropwise over 40 minutes while maintaining the reaction temperature below 25 degrees C. Mixed vinylidene 1000 Mn polyisobutylene, TPC 1105™ available from the Texas Petrochemicals LP, (4999 g; 5.00 moles) mixed with toluene (880 g; 0.95 moles), is then added drop wise over a 150 minute period maintaining the reaction temperature below 25 degrees C. The mixture is then stirred for 8 hours at 20 to 25 degrees C. Calcium hydroxide (160 g; 2.16 moles) is then added along with ammonium hydroxide (9 g; 0.18 moles) to quench the catalyst. The resulting material is then filtered and vacuum stripped to remove the solvent and any residual ortho cresol. 1000.8 grams of the resulting material, a polyisobutylene cresol, is then added to a second reaction vessel, equipped as the first vessel described above.

In the second reaction vessel, the polyisobutylene cresol (1000.8 g; 0.91 moles) is mixed with methanol (288 g; 9 moles). The mixture is then stirred and warmed to 60 degrees C. Potassium hydroxide (10 g; 0.178 moles) and water (15 g; 0.83 moles) is added, causing the reaction mixture to change color from a cream color to a lilac. Paraformaldehyde (40.8 g; 1.36 moles) was then charged to the batch and maintained at 64 degrees C. for 4 hours. An additional charge of potassium hydroxide (2 g; 0.36 moles) and water (3 g; 0.17 moles) is added in addition to paraformaldehyde (13.5 g; 0.45 moles). The batch is then held at 64 degrees C. for another 4 hours. 330 grams of xylene is added and the mixture is then vacuum stripped, keeping the batch temperature below 30 degrees C. to remove the methanol. The resulting material is a polyisobutylene cresol methyl hydroxyl product.

Comparative Example 3

To a 600 ml autoclave reaction vessel the polyisobutylene cresol methyl hydroxyl product (108 g; 0.07 moles) prepared in Comparative Example 2 is added. Methanol (197 g; 6.1 moles) and petroleum naphtha solvent (32 g) are added to the vessel. The vessel is then sealed and purged with nitrogen and then the mixture is stirred and warmed to 150 degrees C. The reaction vessel is held at 150 degrees C. for 60 minutes and then allowed to cool to 30 degrees C. The resulting mixture has two distinct phases. The methanol containing phase is decanted and discarded. The remaining phase contains the product, a polyisobutylene cresol methoxy methyl product in petroleum naphtha solvent.

Comparative Example 4

A nitrogen free additive is prepared by adding resorcinol (90 g; 0.818 moles), mixed with toluene (124 g; 1.35 moles), to a 1-liter glass reaction flask equipped with cold water condenser, caustic scrubber, subline addition tube, thermocouple, and over head mechanical stirrer. The mixture is stirred for 15 minutes under a nitrogen blanket. The catalyst $BF_3$ etherate (12.3 g; 0.087 moles) is added dropwise over 30 minutes while maintaining the reaction temperature below 25 degrees C. Mixed vinylidene 1000 Mn polyisobutylene, TPC 1105™ available from the Texas Petrochemicals LP, (315 g; 0.315 moles) mixed with toluene (90 g; 0.98 moles), is then added drop wise over an 80 minute period maintaining the reaction temperature below 25 degrees C. The mixture is then stirred for 24 hours at 20 to 25 degrees C. Calcium hydroxide (26.5 g; 0.358 moles) is then added to quench the catalyst. The reaction mixture is then filtered and vacuum stripped to remove the solvent. The resulting product is a polyisobutylene resorcinol nitrogen free additive.

The examples described above are tested in a 1985 BMW 318i automobile engine test using a modified version of ASTM D5500) and the M111E engine test (CEC SG-F-0202), both of which measure Inlet Valve Deposits (IVD). The lower the IVD deposit measured in the test, the more efficient the detergent additive. All examples were added to a standard gasoline test fuel at the treat rates described below.

TABLE 1

BMW Engine Test Data

| Test Run | Additive Present | Treat rate (ppm m/m) | Measured IVD |
|---|---|---|---|
| 1-A | Comp Ex 1 | 110 | 83.6 mg |
| 1-B | Ex 2 | 110 | 68.8 mg |

TABLE 2

M111E Engine Test Data

| Test Run | Additive Present | Treat rate (detergent actives*, ppm m/m) | Measured IVD |
|---|---|---|---|
| 2-A | Comp Ex 1 | 110 | 18 mg |
| 2-B | Example 1 | 110 | 33 mg |
| 2-C | Comp Ex 4 | 110 | 234 mg |
| 2-D | Base Fuel | 0 | 239 mg |

*detergent actives defined as derivatized PIB Phenol

The results in table 1 show that Example 3 provides equivalent IVD control to Comparative Example 1 in the BMW test. The results in table 2 show that Examples 1 and 2 provide equivalent IVD control to Comparative Example 1. The inventive examples are also produced by the significantly less complicated and lower cost one step process described above as opposed to the more complicated multiple step process required by the additive of comparative examples. This IVD control performance provided by the nitrogen free additives of the present invention and specifically those derived from the one step process of preparation described above is an unexpected result.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, all percent values shown herein are weight percents. Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

In addition, all the embodiments described above have been contemplated as to their use, both alone and in combination, with all of the other embodiments described above, and these combinations are considered to be part of the present invention.

What we claim:

1. A composition comprising (a) a nitrogen-free detergent fuel additive represented by Formula I;

Formula I

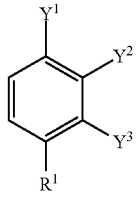

wherein:

$R^1$ is a hydrocarbyl group derived from polyisobutylene having a number average molecular weight of 350 to 3000;

each $Y^1$, $Y^2$ and $Y^3$ is independently —H or —$OR^2$ where each $R^2$ is independently hydrogen or a hydrocarbyl group containing 1 to 10 carbon atoms; so long as at least two of $Y^1$, $Y^2$ and $Y^3$ are —$OR^2$ and where at least two —$OR^2$ groups are adjacent to one another; and $R^1$ and each $R^2$ are free of nitrogen, and (b) a fuel.

2. The composition of claim 1 wherein each $R^2$ is independently hydrogen or a hydrocarbyl group containing 1 to 6 carbon atoms and wherein $R^1$ contains from 25 to 165 carbon atoms.

3. The composition of claim 1 wherein the additive comprises a mixture of one or more additives selected from the group consisting of:

a) the additive represented by Formula I wherein $Y^1$ is —$OR^2$, $Y^2$ is —$OR^2$, $Y^3$ is —H and $R^1$ is derived from polyisobutylene having a number average molecular weight of 350 to 3000;

b) the additive represented by Formula I wherein $Y^1$ is —H, $Y^2$ is —$OR^2$, $Y^3$ is —$OR^2$ and $R^1$ is derived from polyisobutylene having a number average molecular weight of 350 to 3000; and c) the additive represented by Formula I wherein $Y^1$ is —$OR^2$, $Y^2$ is —$OR^2$, $Y^3$ is —$OR^2$ and $R^1$ is derived from polyisobutylene having a number average molecular weight of 350 to 3000.

4. The composition of claim 1 wherein the nitrogen-free detergent fuel additive is derived from the reaction of:

(a) a compound represented by Formula II;

Formula II

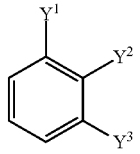

wherein each $Y^1$, $Y^2$ and $Y^3$ is independently —H or —$OR^2$ where each $R^2$ is independently hydrogen or a hydrocarbyl group containing 1 to 10 carbon atoms; so long as at least two of $Y^1$, $Y^2$ and $Y^3$ are —$OR^2$ and where at least two —$OR^2$ groups are adjacent to one another; and each $R^2$ is free of nitrogen; and (b) a polyisobutylene having a number average molecular weight of 350 to 3000 wherein the polyisobutylene compound is nitrogen free.

5. The composition of claim 4 wherein the reaction is carried out in the presence of a toluene solvent and a boron trifluoride catalyst.

6. The fuel additive composition of claim 1 further comprising one or more optional additional performance additives as component (c), wherein component (c) comprises an antioxidant, a corrosion inhibitor, another detergent/dispersant additive, a cold flow, a foam inhibitor, a demulsifier, a lubricity agent, a metal deactivator, a valve seat recession additive, a biocide, an antistatic agent, a deicer, a fluidizer, a fluidizer extender, a combustion improver, a friction modifier, or some combination thereof.

7. The fuel composition of claim 1 wherein component (a) is present in an amount of about 10 ppm to 2500 ppm.

8. A method of preparing a nitrogen-free detergent fuel additive represented by Formula I;

Formula I

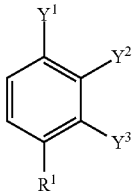

wherein:

$R^1$ is a hydrocarbyl group derived from polyisobutylene having a number average molecular weight of 350 to 3000;

each $Y^1$, $Y^2$ and $Y^3$ is independently —H or —$OR^2$ where each $R^2$ is independently hydrogen or a hydrocarbyl group containing 1 to 10 carbon atoms; so long as at least two of $Y^1$, $Y^2$ and $Y^3$ are —$OR^2$ and where at least two —$OR^2$ groups are adjacent to one another; and $R^1$ and each $R^2$ are free of nitrogen; comprising the steps of:

(i) reacting:

(a) a compound represented by Formula II;

Formula II

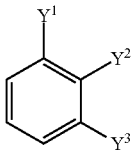

wherein each $Y^1$, $Y^2$ and $Y^3$ is independently —H or —$OR^2$ where each $R^2$ is independently hydrogen or a hydrocarbyl group containing 1 to 10 carbon atoms; so long as at least two of $Y^1$, $Y^2$ and $Y^3$ are —$OR^2$ and where at least two —$OR^2$ groups are adjacent to one another; and each $R^2$ is free of nitrogen; and (b) a polyisobutylene having a number average molecular weight of 350 to 3000 wherein the polyisobutylene compound is nitrogen free.

9. The method of claim 8 wherein the reaction is carried out in the presence of a toluene solvent and a boron trifluoride catalyst.

10. A method of operating an internal combustion engine, comprising the steps of (i) supplying to said engine a fuel composition comprising:

(a) a nitrogen-free detergent additive represented by Formula I;

Formula I

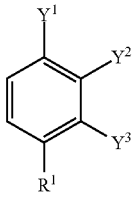

wherein:

$R^1$ is a hydrocarbyl group derived from polyisobutylene having a number average molecular weight of 350 to 3000;

each $Y^1$, $Y^2$, and $Y^3$ is independently —H or —$OR^2$ where each $R^2$ is independently hydrogen or a hydrocarbyl group containing 1 to 10 carbon atoms; so long as at least two of $Y^1$, $Y^2$, and $Y^3$ are —$OR^2$ and where at least two —$OR^2$ groups are adjacent to one another; and $R^1$ and each $R^2$ are free of nitrogen; and (b) a fuel.

* * * * *